US008407866B2

(12) United States Patent
Pontaoe

(10) Patent No.: US 8,407,866 B2
(45) Date of Patent: Apr. 2, 2013

(54) FOLDABLE ATTACHMENT CLIP

(75) Inventor: John S. Pontaoe, Chicago, IL (US)

(73) Assignee: Illinois Tool Works Inc., Glenview, IL (US)

( * ) Notice: Subject to any disclaimer, the term of this patent is extended or adjusted under 35 U.S.C. 154(b) by 167 days.

(21) Appl. No.: 12/909,966

(22) Filed: Oct. 22, 2010

(65) Prior Publication Data

US 2011/0099774 A1 May 5, 2011

Related U.S. Application Data

(60) Provisional application No. 61/256,555, filed on Oct. 30, 2009, provisional application No. 61/360,538, filed on Jul. 1, 2010.

(51) Int. Cl.
*A44B 11/25* (2006.01)

(52) U.S. Cl. ..... 24/313; 24/698.1

(58) Field of Classification Search ..... 24/698.1, 24/698.2, 702, 669, 684, 662, 663, 199, 588.1, 24/588.11, 590.1, 600.9, 601.2, 601.4, 601.7, 24/198, 200, 310–313, 321, 323, 618
See application file for complete search history.

(56) References Cited

U.S. PATENT DOCUMENTS

| | | | | |
|---|---|---|---|---|
| 736,576 | A * | 8/1903 | Camp | 2/221 |
| 1,821,839 | A * | 9/1931 | Kerngood | 24/312 |
| 3,121,931 | A * | 2/1964 | Diaz | 24/682.1 |
| 3,165,803 | A * | 1/1965 | Gaylord | 24/684 |
| 3,936,914 | A * | 2/1976 | Mancini | 24/684 |
| 4,010,501 | A * | 3/1977 | Cooke | 441/118 |
| 4,501,027 | A * | 2/1985 | Olsson | 2/321 |
| 6,023,820 | A * | 2/2000 | Fair | 24/614 |
| 6,170,130 | B1 | 1/2001 | Hamilton et al. | |
| 6,360,404 | B1 * | 3/2002 | Mudge et al. | 24/3.4 |
| 6,513,209 | B1 * | 2/2003 | Portzline | 24/701 |
| 6,735,826 | B2 | 5/2004 | Uehara et al. | |
| D525,168 | S * | 7/2006 | Pontaoe | D11/208 |
| 7,107,941 | B2 * | 9/2006 | Wang | 119/865 |
| 2007/0089280 | A1 | 4/2007 | Pontaoe | |
| 2008/0134479 | A1 | 6/2008 | Kolasa et al. | |
| 2009/0007391 | A1 | 1/2009 | Uehara | |
| 2009/0056089 | A1 | 3/2009 | Yoshie | |

FOREIGN PATENT DOCUMENTS

GB 2415736 A * 1/2006

OTHER PUBLICATIONS

Prior Art Samples.

* cited by examiner

*Primary Examiner* — James Brittain
(74) *Attorney, Agent, or Firm* — Mark W. Croll; Paul F. Donovan

(57) ABSTRACT

A foldable attachment clip assembly including a receiving body portion having a hollow interior and a slotted opening extending along the length which receives and retains a crossbar of a stirrup connection portion. The crossbar of the stirrup connection portion is adapted for press-fit insertion through the relatively narrow width slotted opening which opens into a wider diameter retention pocket at the interior of the receiving body portion. Following attachment, the receiving body portion and the stirrup connection portion can rotate relative to one another about an axis defined generally by the crossbar within the retention pocket. Upon application of a tensioning force, the clip is substantially straightened and the receiving body pulls tight against the crossbar in a secure relation.

20 Claims, 5 Drawing Sheets

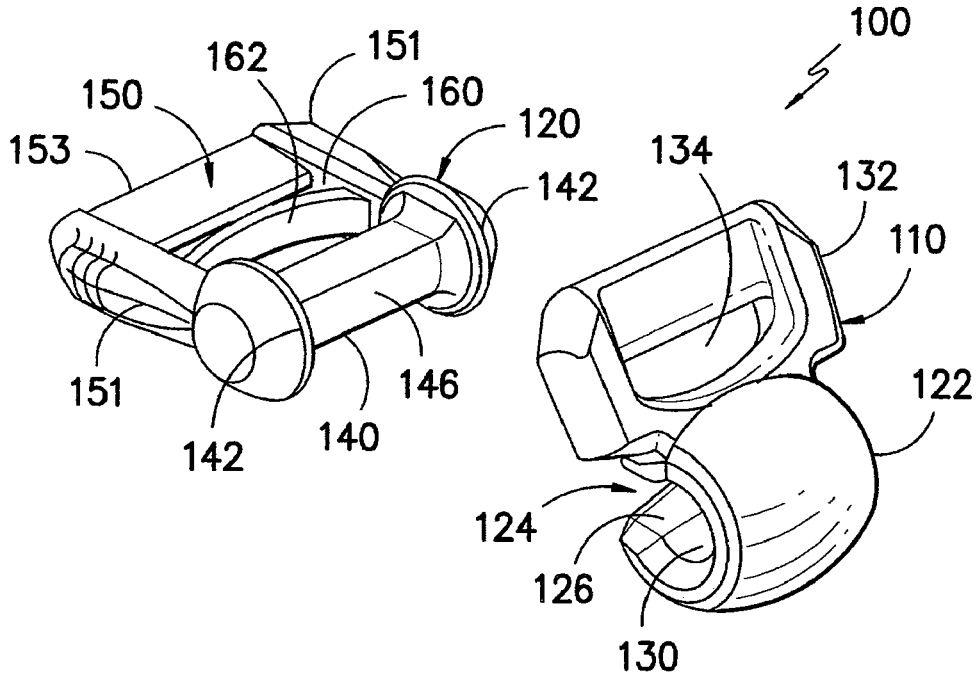
FIG. –1–
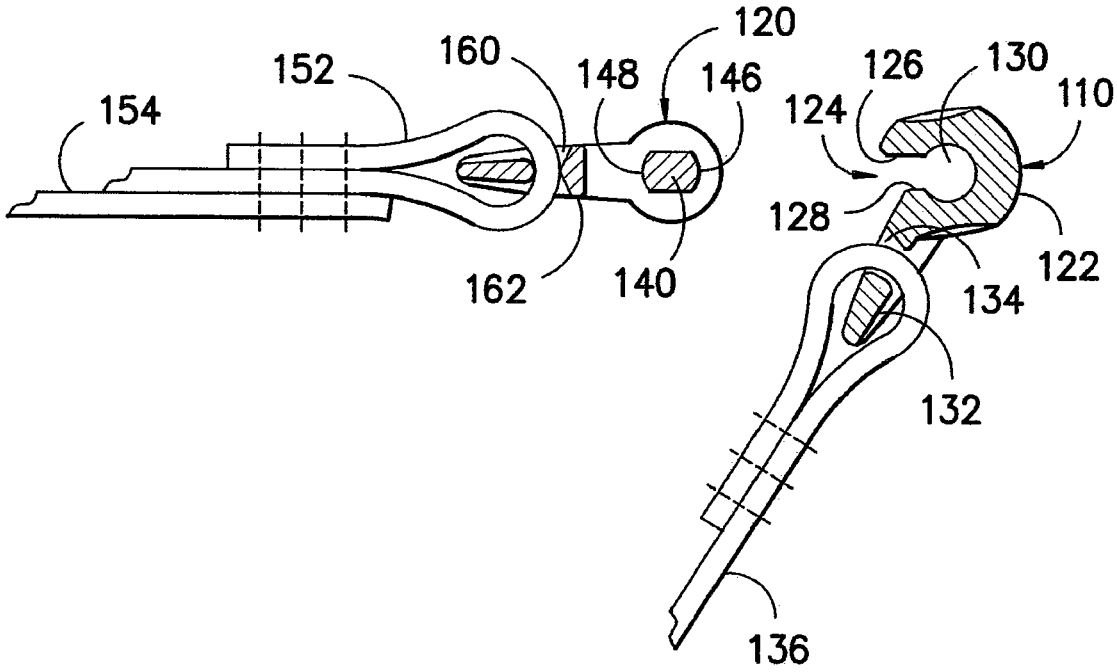
FIG. –2–

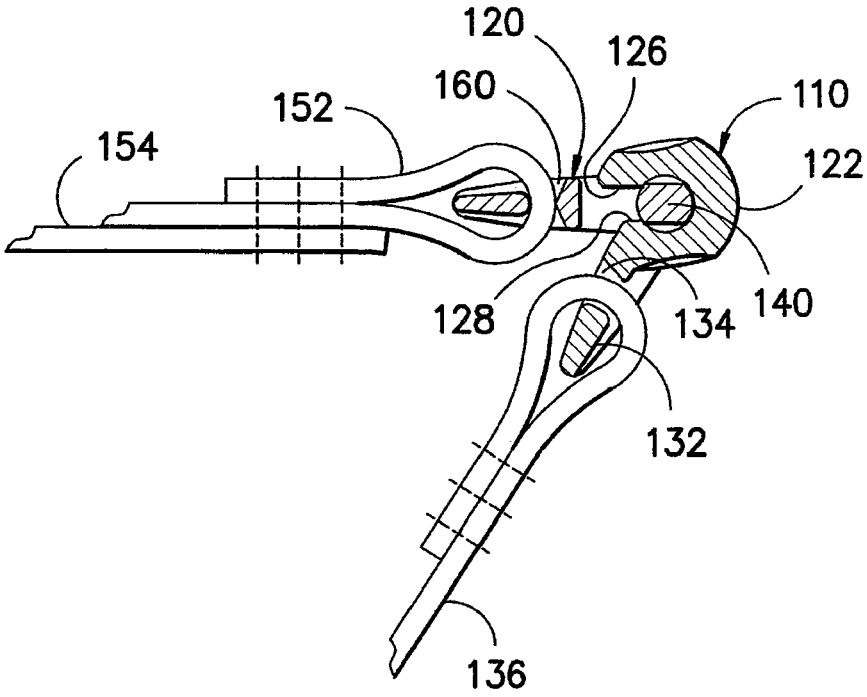
FIG. –3–
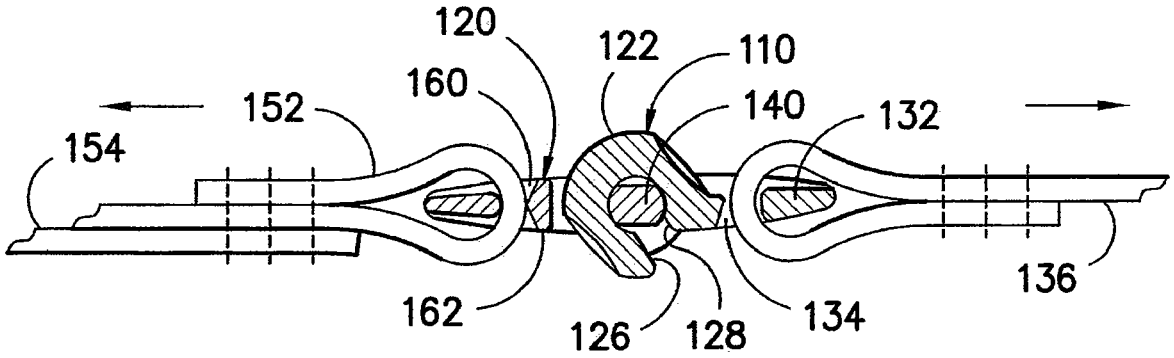
FIG. –4–

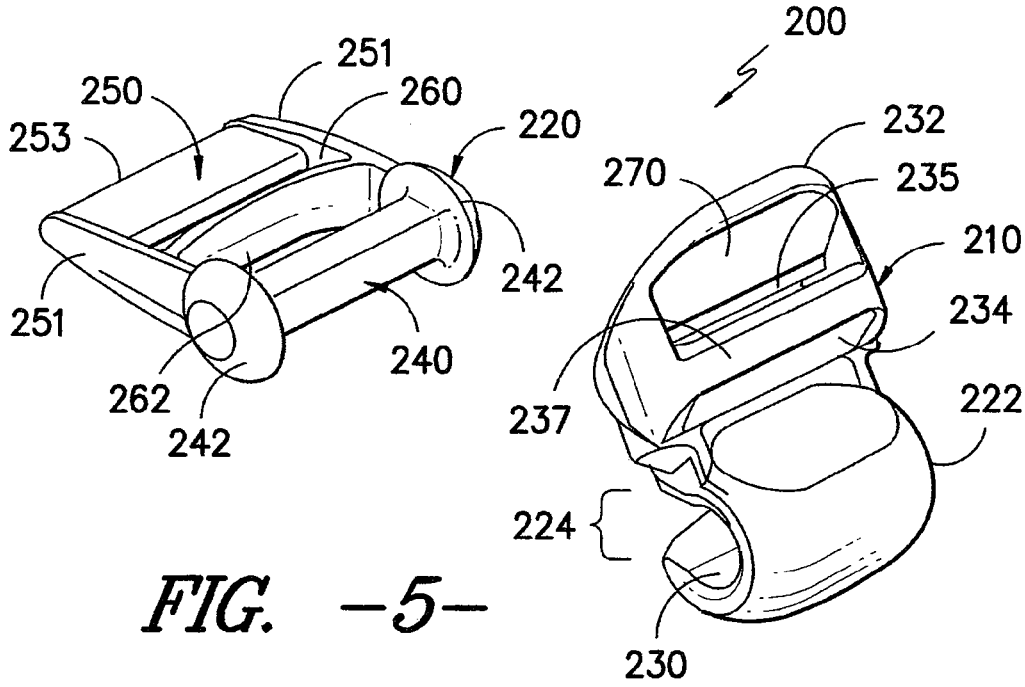
FIG. –5–
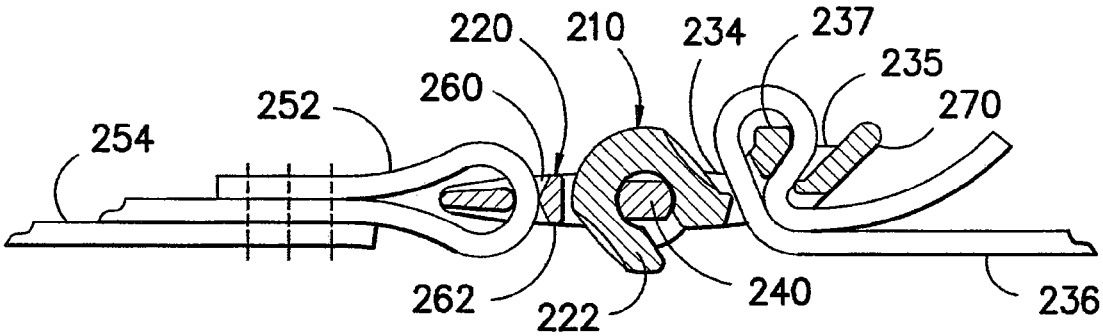
FIG. –6–
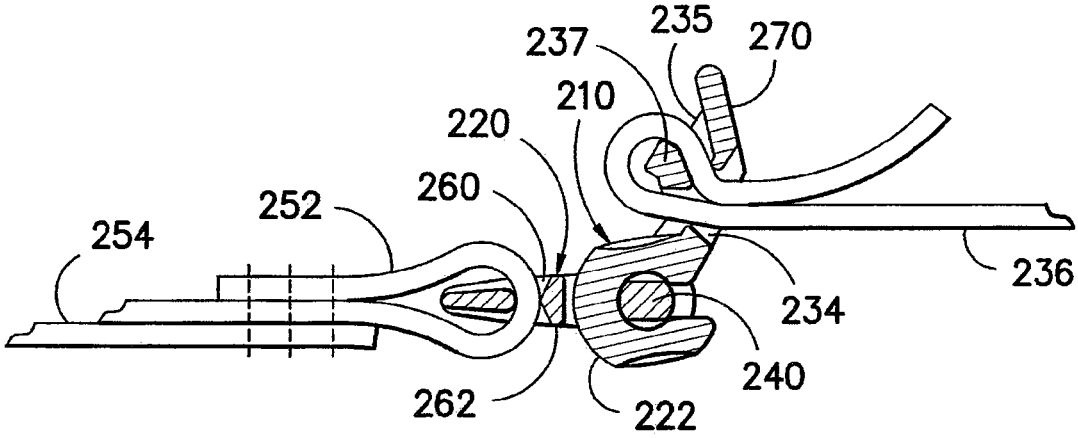
FIG. –7–

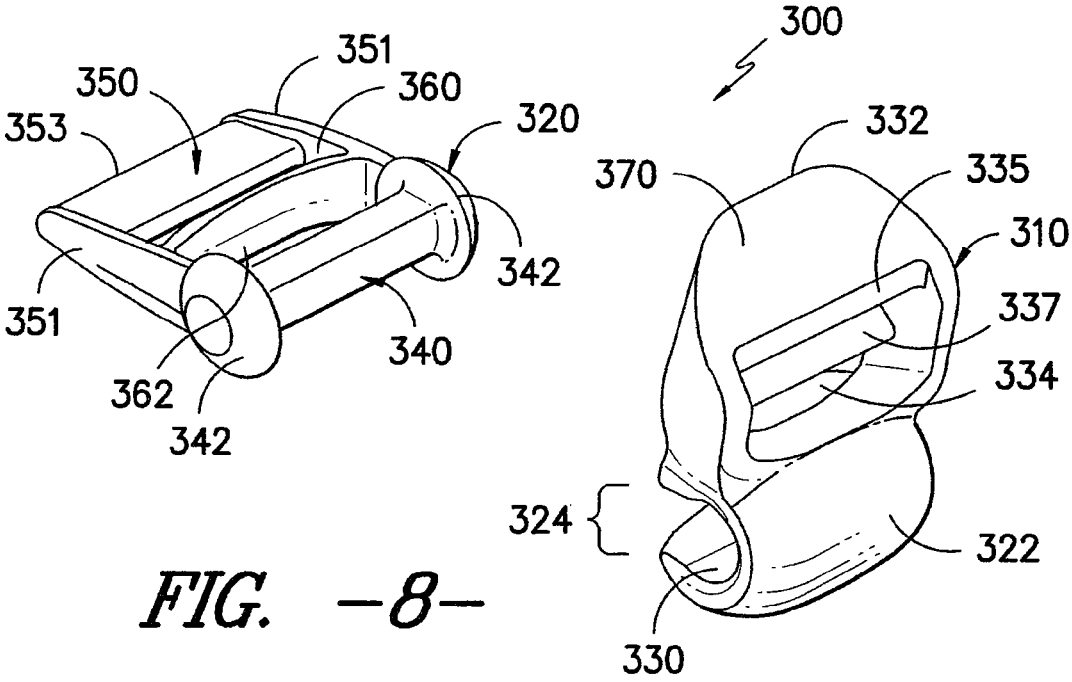
FIG. —8—
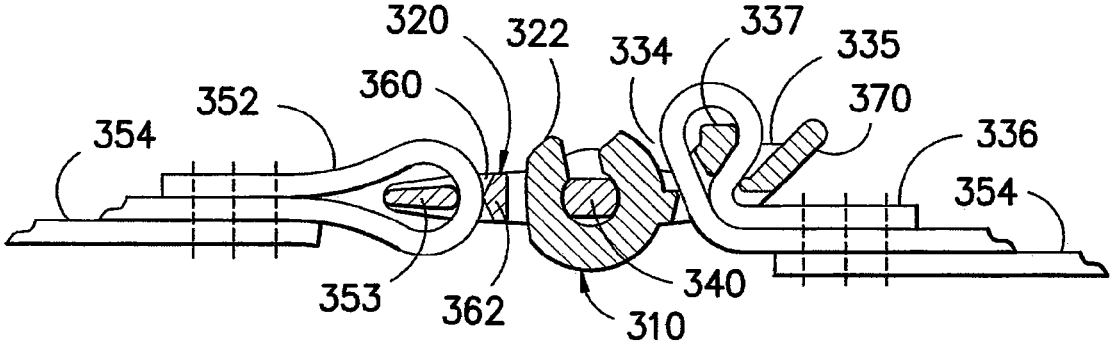
FIG. —9—
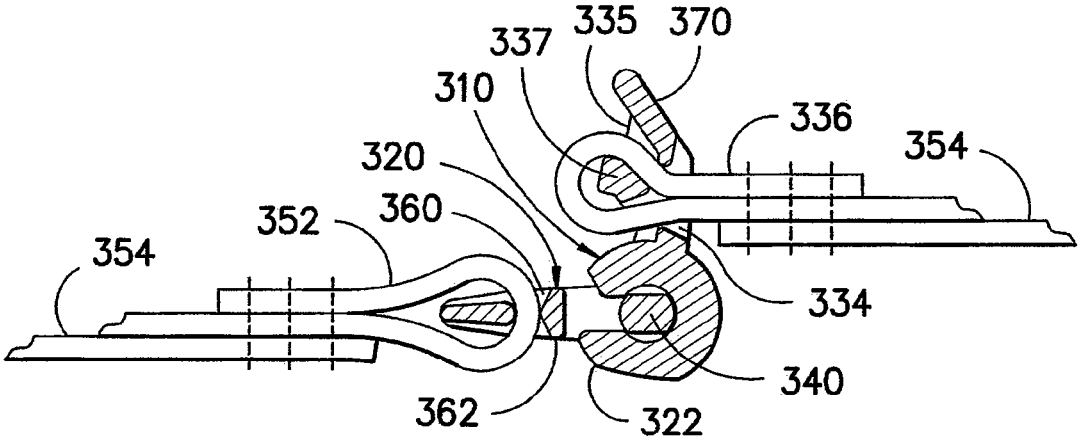
FIG. —10—

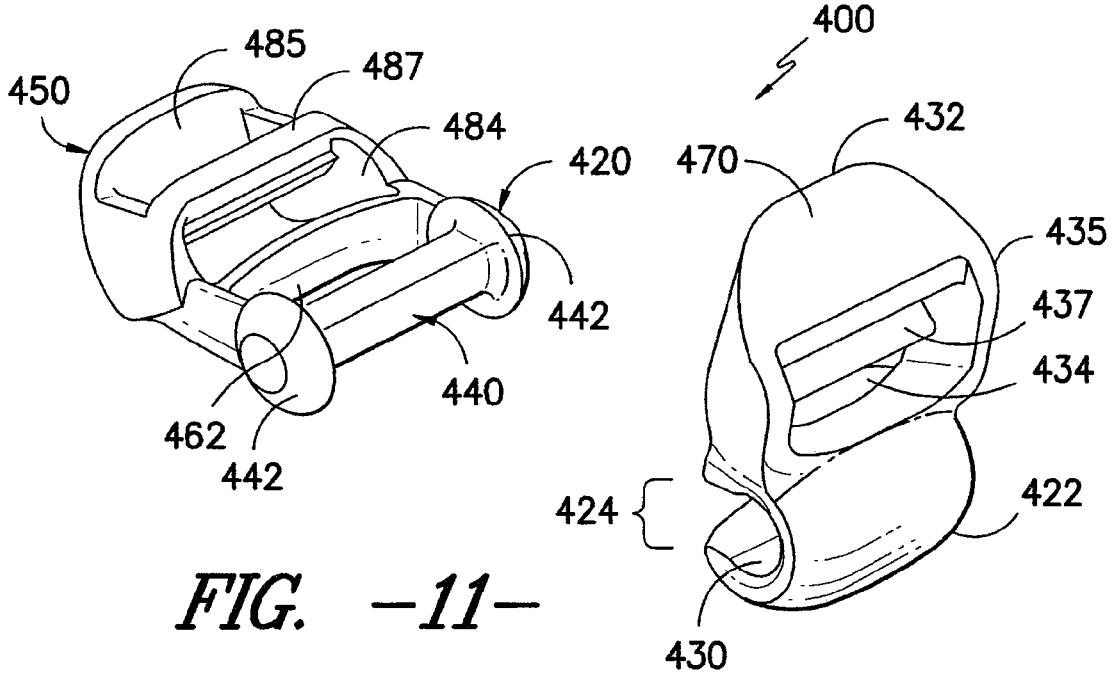
FIG. –11–
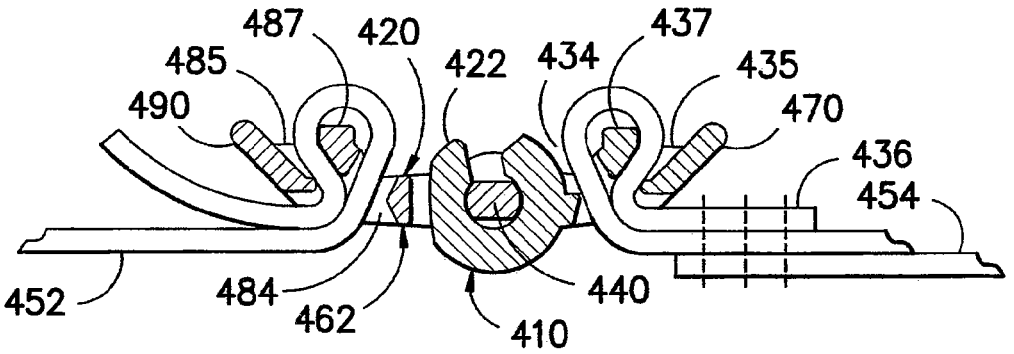
FIG. –12–
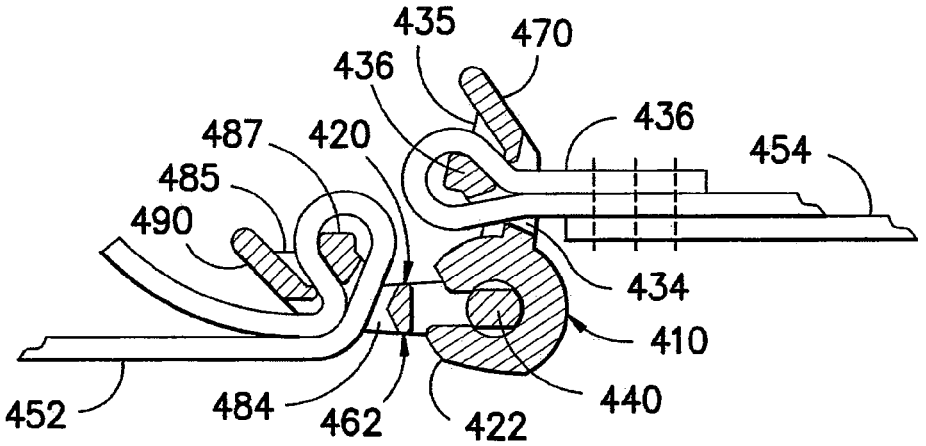
FIG. –13–

FOLDABLE ATTACHMENT CLIP

CROSS-REFERENCE TO RELATED APPLICATION

This non-provisional application claims the benefit of, and priority from, U.S. Provisional Applications 61/256,555 filed Oct. 30, 2009 and 61/360,538 filed Jul. 1, 2010, each of which is hereby incorporated by reference in its entirety as if fully set forth herein.

TECHNICAL FIELD

The present invention relates generally to snap-together clips for operatively joining straps or similar structures and more particularly to a clip having a stirrup portion and an engageable hook portion which snaps around the crossbar of the stirrup portion. In the snapped-together state, the hook portion is rotatable at least partially about the stirrup crossbar to adopt a folded structure. The hook portion and/or the stirrup portion may include one or more eyelets for acceptance and retention of strap members for tensioning adjustment.

BACKGROUND OF THE INVENTION

Clips for connecting a strap to a second strap or other structure are well known to those of skill in the art. By way of example only, such clips may be used for fastening backpacks, luggage or other articles.

One prior clip arrangement incorporates a male member with a pair of laterally disposed legs that snap in locking relation within a relatively flat female body. In such a construction portions of the snap legs typically project through openings in the lateral sides of the female body in locking relation. The locking relation is disengaged by a user pressing inwardly against the lateral sides of the body to force the snap legs to the interior while applying a separating tensioning force. This permits the legs to be pulled outwardly from the body. While such prior structures are suitable for many applications, one deficiency is that the clip cannot bend in the assembled condition. Thus, a user's movement may be restricted. Moreover, when substantial tension is applied, that tension must be carried by the snap legs and the female body, thereby requiring the use of materials of enhanced thickness and/or strength in those components.

Another prior clip arrangement incorporates a relatively large diameter "J" hook with a leaf spring closure. The "J" hook can snap loosely through a connection eyelet. However, in the connected relation there can be substantial lateral relative movement between the "J" hook and the eyelet. Moreover, in the event that the leaf spring closure is damaged, the "J" hook will tend to become disengaged due to the large entrance opening which tends to be much larger than the connection eyelet.

In light of the above, it would be desirable to provide an attachment clip which permits relative rotation of the components in the assembled condition and which also maintains the snapped-together relationship in tensioned and untensioned states.

SUMMARY OF THE INVENTION

The present invention offers advantages and alternatives over the prior art by providing a foldable attachment clip assembly including a receiving body portion having a hollow interior and a slotted opening extending along the length which receives and retains a crossbar of a stirrup connection portion. The crossbar of the stirrup connection portion is adapted for press-fit insertion through the relatively narrow width slotted opening which opens into a wider diameter retention pocket at the interior of the body portion. Following attachment, the receiving body portion and the stirrup connection portion can rotate relative to one another about an axis defined generally by the crossbar within the retention pocket. Upon application of a tensioning force, the clip is substantially straightened and the receiving body pulls tight against the crossbar in a secure relation.

In accordance with one exemplary aspect, the present invention provides a foldable attachment clip assembly including a stirrup member having a crossbar oriented between opposing lateral legs. The clip assembly further includes a hook member including a receiving body adapted to receive the crossbar and an eyelet extension adapted to receive a strap element extending away from the receiving body. The receiving body has a hollow interior with a slot opening extending along the length of the receiving body. The slot opening has a height dimension which is less than or equal to the height dimension of the crossbar. The slot opening defines an insertion path across a wall of the receiving body adapted for press-fit insertion of the crossbar to a portion of the hollow interior defining a retention pocket adapted to receive the crossbar. The retention pocket has an effective diameter which is greater than the effective diameter of the crossbar such that the hook member can rotate about the crossbar following insertion of the crossbar.

In accordance with another exemplary aspect, the present invention provides a foldable attachment clip assembly including a stirrup member having a crossbar extending between a pair of enhanced diameter end walls. The crossbar includes flattened upper and lower surfaces with a height dimension between the upper and lower surfaces. The stirrup member further includes a first eyelet extension having at least one eyelet disposed at a position remote from the crossbar between a rear cross member and a barrier element disposed in opposing relation to the crossbar. The clip assembly includes a hook member having a substantially cylindrical receiving body adapted to receive the crossbar and a second eyelet extension extending away from the receiving body. The receiving body has a hollow interior with a slot opening extending along the length of the receiving body. The slot opening has a pair of opposing planar boundary surfaces with the distance between the boundary surfaces defining the height dimension of the slot opening which is less than or equal to the height dimension of the crossbar. The slot opening defines an insertion path across a wall of the receiving body adapted for press-fit insertion of the crossbar to a portion of the hollow interior defining a retention pocket adapted to receive the crossbar. The retention pocket has an effective diameter which is greater than the effective diameter of the crossbar such that the hook member can rotate about the crossbar following insertion of the crossbar. The second eyelet extension includes at least one eyelet adapted to receive a strap element.

In accordance with another exemplary aspect, the present invention provides a foldable attachment clip assembly including a stirrup member having a crossbar extending between opposing lateral legs of the stirrup member, the crossbar having flattened upper and lower surfaces with a height dimension between the upper and lower surfaces. The stirrup member further includes a first eyelet extension having at least one eyelet disposed at a position remote from the crossbar between a rear cross member and a curved barrier element disposed in opposing relation to the crossbar. The clip assembly includes a hook member having a substantially cylindrical receiving body adapted to receive the crossbar and a second eyelet extension extending away from the receiving body. The receiving body has a generally "C" shaped cross-sectional profile with a hollow interior and a slot opening extending along the length of the receiving body. The slot opening has a pair of opposing planar boundary surfaces with the distance between the boundary surfaces defining the height dimension of the slot opening which is less than or equal to the height dimension of the crossbar. The slot opening defines an insertion path across a wall of the receiving body adapted for press-fit insertion of the crossbar to a portion of the hollow interior defining a retention pocket adapted to receive the crossbar. The retention pocket has an effective diameter which is greater than the effective diameter of the crossbar such that the hook member can rotate about the crossbar following insertion of the crossbar. The length of the receiving body is substantially equivalent to the distance between the enhanced diameter end walls to block relative axial movement between the receiving body and the crossbar. The first eyelet extension and/or the second eyelet extension includes a first pass through opening and at least a second pass through opening adapted to receive an adjustment strap.

BRIEF DESCRIPTION OF THE DRAWINGS

FIG. 1 is a schematic view of one embodiment of a foldable attachment clip assembly in accordance with the present invention;

FIG. 2 is a cross-sectional view of the foldable attachment clip assembly of FIG. 1 illustrating a male stirrup portion and a female hook portion in aligned relation for engagement;

FIG. 3 is a cross-sectional view of the foldable attachment clip assembly of FIG. 1 illustrating the male stirrup portion and the female hook portion in engaged relation with the components aligned for insertion and withdrawal;

FIG. 4 is a cross-sectional view similar to FIG. 3 illustrating the male stirrup portion and the female hook portion in engaged relation with the components rotated to a substantially straight condition consistent with tensioning;

FIG. 5 is a schematic view of another embodiment of a foldable attachment clip assembly in accordance with the present invention;

FIG. 6 is a cross-sectional view of the attachment clip assembly of FIG. 5 illustrating the male stirrup portion and the female hook portion in engaged relation with attached strap elements and with the components rotated to a substantially straight condition consistent with tensioning;

FIG. 7 is a cross-sectional view similar to FIG. 3 illustrating the male stirrup portion and the female hook portion in engaged relation and rotated to a folded condition while maintaining engagement;

FIG. 8 is a schematic view of another embodiment of a foldable attachment clip assembly in accordance with the present invention;

FIG. 9 is a cross-sectional view of the attachment clip assembly of FIG. 8 illustrating the male stirrup portion and the female hook portion in engaged relation with attached strap elements and with the components rotated to a substantially straight condition consistent with tensioning; and FIG. 10 is a cross-sectional view similar to FIG. 7 illustrating the male stirrup portion and the female hook portion in engaged relation and rotated to a folded condition to effect disengagement of the male stirrup portion from the female hook portion;

FIG. 11 is a schematic view of another embodiment of a foldable attachment clip assembly in accordance with the present invention;

FIG. 12 is a cross-sectional view of the attachment clip assembly of FIG. 11 illustrating the male stirrup portion and the female hook portion in engaged relation with attached strap elements and with the components rotated to a substantially straight condition consistent with tensioning; and FIG. 13 is a cross-sectional view similar to FIG. 10 illustrating the male stirrup portion and the female hook portion in engaged relation and rotated to a folded condition to effect disengagement of the male stirrup portion from the female hook portion;

Before the exemplary embodiments of the invention are explained in detail, it is to be understood that the invention is in no way limited in its application or construction to the details and the arrangements of the components set forth in the following description or illustrated in the drawings. Rather, the invention is capable of other embodiments and being practiced or being carried out in various ways. Also, it is to be understood that the phraseology and terminology used herein are for purposes of description only and should not be regarded as limiting. The use herein of terms such as "including" and "comprising" and variations thereof is meant to encompass the items listed thereafter and equivalents thereof as well as additional items and equivalents thereof.

DETAILED DESCRIPTION OF THE PREFERRED EMBODIMENTS

Exemplary embodiments of the invention will now be described in reference to the drawings, wherein like reference numerals designate like elements in the various views. Referring now in particular to FIGS. 1-4, a clip assembly 100 is illustrated. As shown, the clip assembly 100 includes a hook member 110 and a cooperating stirrup member 120 which are adapted to fit in snap relation relative to one another in a manner as best seen in FIG. 3. Upon engagement, the hook member 110 and the stirrup member 120 may articulate in a hinging manner relative to one another while maintaining an engaged relation. Moreover, upon the application of tensioning forces as illustrated by force arrows in FIG. 4, the stirrup member 120 assumes a highly stable seated relation within the hook member 110.

In the illustrated exemplary embodiment, the hook member 110 includes a receiving body 122 having a generally hollow interior adapted to receive and retain a portion of the stirrup member 120 in a manner as will be described further hereinafter. In the illustrated exemplary construction, the receiving body 122 is generally cylindrical in the form of a circular barrel with an enhanced outer diameter at its center relative to its ends. However, other configurations including, without limitation, straight cylinders, elongate polygonal cylinder structures or the like may also be used.

As best seen in FIG. 2, the receiving body 122 has a generally "C" shaped cross-section having a slot opening 124 including a pair of substantially flat boundary surfaces 126, 128 disposed in opposing relation to one another. The slot opening 124 opens into an enhanced diameter retention pocket 130. While the retention pocket 130 is illustrated as having a generally semicircular profile, other configurations including ovals, polygonal surfaces and the like may be used if desired. In the illustrated exemplary arrangement, both the slot opening 124 and the retention pocket 130 extend substantially along the length of the receiving body 122 and the ends of the receiving body are open.

As shown, in the exemplary arrangement, an eyelet extension 132 extends away from one edge of the slot opening 124 in a plane transverse to the slot opening 124. The eyelet extension includes at least one pass through opening 134

(FIG. 1) for threading a strap element 136 such as cord material, rope, webbing or the like. In the exemplary construction, the eyelet extension 132 is oriented transverse to the slot opening 124 such that the application of a tensioning force will cause the receiving body 122 to rotate away from the insertion condition (FIG. 3) and to a locked condition (FIG. 4). In the illustrated construction, the eyelet extension 132 is in a slightly forward angled orientation relative to the slot opening 124 such that the eyelet extension 132 projects generally away from the base of the retention pocket 130. Thus, the combination of the receiving body 122 and the eyelet extension 132 defines a cross-sectional profile generally in the form of a shepherd's crook. By way of example only, and not limitation, the hook member 110 may be formed as a single piece from polymeric structural materials such as nylon, polyester, polypropylene, ABS or the like using injection molding or other suitable formation practices as may be known to those of skill in the art.

As noted previously, the slot opening 124 is adapted to receive a portion of the stirrup member 120 to be held rotatably within the retention pocket 130. In the illustrated exemplary embodiment the stirrup member 120 includes a crossbar designated generally as 140. The crossbar 140 is oriented with its length dimension extending between opposing end walls 142 (FIG. 1). As shown, the end walls 142 are of enhanced diameter relative to the crossbar 140. In the illustrated exemplary construction, the crossbar 140 may incorporate generally flattened upper and lower surfaces. As shown, the crossbar 140 also may include a rounded leading edge 146 and a rounded trailing edge 148 (FIG. 2) to facilitate insertion into the slot opening and subsequent rotation within the retention pocket 130 following assembly. In the illustrated exemplary construction the width dimension of the crossbar 140 extending between the leading edge 146 and the trailing edge 148 is greater than the height dimension extending between the flattened upper and lower surfaces.

In the exemplary construction, the stirrup member 120 includes an eyelet extension 150 defining a tethering connection extending away from the crossbar 140 for retention of a strap element 152 such as webbing, cord material, rope or the like. In the illustrated embodiment, the eyelet extension 150 is substantially co-planar with the crossbar 140 and includes a pair of lateral legs 151 and a rear cross member 153 extending between the lateral legs 151. However, other configurations may be used if desired. In practice, the strap element 152 may be secured to a base panel 154 such as a fabric substrate or the like such that the stirrup member 120 is anchored in a floating relation relative to the base panel 154. The strap element 152 may be secured to the base panel 154 by techniques such as stitching, adhesive bonding or other techniques as may be desired t act as a tether. By way of example only, and not limitation, the base panel 154 may be a portion of a backpack, clothing article, or other structure to be closed by the clip assembly 100.

As shown, the eyelet extension 150 may include at least one tethering eyelet 160 disposed in spaced-apart relation from the crossbar 140 for acceptance of the strap element 152. In the illustrated configuration, the tethering eyelet 160 is separated from the crossbar 140 by a barrier 162 which extends between the lateral legs 151 at a position between the crossbar 140 and the rear cross member 153. As shown, the barrier 162 may be curved to substantially match the curvature at the outer surface of the receiving body 122 if desired such that the barrier 162 defines a concave profile opposing the crossbar and cradles the receiving body 122 during relative rotation. Of course, the barrier 162 may also be substantially straight if desired. By way of example only, and not limitation, the stirrup member 120 may be formed as a single piece from polymeric structural materials such as nylon, polyester, polypropylene, ABS or the like using injection molding or other suitable formation practices as may be known to those of skill in the art.

In the exemplary construction, the height dimension of the crossbar 140 extending between the flattened upper and lower surfaces substantially matches or is slightly greater than the height dimension of the slot opening 124. During assembly, a user may orient the stirrup member 120 relative to the slot opening 124 such that the upper and lower surfaces of the crossbar 140 are substantially parallel to the corresponding boundary surfaces 126, 128 of the slot opening 124. In this orientation, the leading edge 146 of the crossbar 140 may then be pressed into the slot opening 124. As insertion proceeds, the slot opening 124 may be forced to flex open to a further extent to permit complete insertion of the crossbar 140. Upon achieving completed insertion, the slot opening 124 may then spring back to its original condition. In the inserted condition, the crossbar 140 is then held within the retention pocket 130 which has a diameter larger than the crossbar 140 such that the crossbar 140 may rotate relatively freely within the retention pocket.

In the illustrated exemplary construction, the length of the receiving body 122 may closely approximate the distance between the end walls 142. As will be appreciated, by matching the length of the receiving body 122 to the distance between the end walls 142, lateral sliding of the hook member relative to the stirrup member 120 may be reduced or eliminated. However, in a low tension or untensioned state, the receiving body 122 nonetheless is able to rotate about the crossbar 140. Of course, it is also contemplated that the length of the receiving body 122 may be shorter than the distance between the end walls 142 if a degree of lateral sliding is desired.

As illustrated through joint reference to FIGS. 3 and 4, upon the introduction of a tensioning force, the receiving body 122 may rotate about the crossbar 140 from the initial assembly position to a position wherein the boundary surfaces 126, 128 of the slot opening 124 become oriented substantially transverse to the flattened upper and lower surfaces of the crossbar 140. In this orientation, the crossbar 140 is blocked against removal through the slot opening 124. Moreover, the crossbar is pressed against the inner surface of the retention pocket in a stable manner. Upon the release of tension, free rotation may then be resumed.

In the event that it is desired to disassemble the clip, the tensioning forces may be relieved and the receiving body 122 may be is rotated back to an orientation in which the boundary surfaces 126, 128 of the slot opening 124 are oriented substantially parallel to the flattened upper and lower surfaces of the crossbar. In this orientation, the crossbar may be pulled out of the receiving body 122 without undue force.

FIGS. 5-7 illustrate a clip assembly 200 representing an alternative embodiment of the present invention wherein elements corresponding to those described previously are designated by like reference numerals within a 200 series. The exemplary clip assembly 200 may be formed from molded polymers or other materials as previously described. In the embodiment of FIGS. 5-7, the receiving body 222 of the hook member 210 engages the crossbar 240 of the stirrup member 220 in the same manner as previously described. In the engaged relation shown in FIGS. 6 and 7, the receiving body 222 is held between the end walls 242 and may rotate about the crossbar 240 relative to the eyelet extension 250.

In the illustrated exemplary construction, the eyelet extension 250 has a configuration substantially as described previously and may include at least one eyelet 260 disposed in spaced-apart relation from the crossbar 240 for acceptance of a strap element 252 which may be anchored to a base panel 254. In the illustrated configuration, the eyelet 260 is separated from the crossbar 240 by the barrier 262 which extends between lateral legs 251 at a position between the crossbar 240 and the rear cross member 253. As shown, the barrier 262 may be curved to substantially match the curvature at the outer surface of the receiving body 222 such that the barrier cradles the receiving body 222 during relative rotation. Of course, the barrier 262 may also be substantially straight if desired.

As shown, in the exemplary embodiment of FIGS. 5-7, the hook member 210 includes an eyelet extension 232 having a forward pass through opening 234 and a rearward pass through opening 235. A spacer 237 separates the forward pass through opening 234 and the rearward pass through opening 235. As will be appreciated, the forward pass through opening 234 and the rearward pass through opening 235 are adapted to receive an adjustment strap 236 such as rope, cord, webbing or the like such that the adjustment strap is threaded around the spacer in a cinching arrangement such that the effective length of the strap element 236 may be lengthened or shortened as desired. As illustrated, in the exemplary configuration the eyelet extension 232 includes an upwardly angled distal wall 270 disposed in raised, sloped relation along a rear edge of the rearward pass through opening 235. As will be appreciated, such an angled surface may facilitate threading and tensioning adjustment. Of course, virtually any other configuration for the eyelet extension which provides length adjustment may be used if desired.

In practice, a user may orient the stirrup member 220 relative to the receiving body 222 such that the upper and lower surfaces of the crossbar 240 are substantially parallel to the corresponding boundary surfaces of the slot opening 224. In this orientation, the leading edge of the crossbar 240 may then be pressed into the slot opening 224. As insertion proceeds, the slot opening 224 may be forced to flex open to a further extent to permit complete insertion of the crossbar 240. Upon achieving completed insertion, the slot opening 224 may then spring back to its original condition. The crossbar 240 is then held within the retention pocket 230 which has a diameter larger than the width dimension of the crossbar 240 such that the crossbar may rotate relatively freely within the retention pocket.

FIGS. 8-10 illustrate a clip assembly 300 representing an alternative embodiment of the present invention wherein elements corresponding to those described previously are designated by like reference numerals within a 300 series. The exemplary clip assembly 300 may be formed from molded polymers or other materials as previously described. In the embodiment of FIGS. 8-10, the receiving body 322 is oriented such that the distal wall 370 projects generally in the same direction as the slot opening 324. This may be contrasted to the embodiment illustrated in FIGS. 5-7 wherein the distal wall projects generally in the opposite direction from the slot opening. As best seen in FIG. 9, in the illustrated embodiment, when the clip assembly 300 is in tension, the slot opening 324 normally projects outwardly away from the plane of the base panel 354. Thus, when linear tension is applied, the crossbar 340 is seated against the side of the retention pocket 330.

Upon the application of an upward folding force away from the plane of the base panel 354, the receiving body 322 rotates to a position in which the crossbar 340 is in alignment with the slot opening 324 (FIG. 10). Such lifting rotation also causes the receiving body to be urged away from the crossbar 340 thereby increasing tension in the anchoring strap 352 holding the stirrup member in place relative to the base panel 354. Accordingly, when the rotation progresses to the condition where the crossbar 340 is aligned with the slot opening 324, the crossbar 340 will pop out of the receiving body 322 to relieve the applied forces thereby resulting in disengagement. As will be appreciated, such an arrangement permits a user to use a single hand to disengage the clip assembly 300 by lifting the distal wall 370 upwardly. Such one-handed disengagement may be desirable in some environments of use where a quick release is desired.

FIGS. 11-13 illustrate a clip assembly 400 representing an alternative embodiment of the present invention wherein elements corresponding to those described previously are designated by like reference numerals within a 400 series. The exemplary clip assembly 400 may be formed from molded polymers or other materials as previously described. In the embodiment of FIGS. 11-13, the receiving body 422 is oriented such that the distal wall 470 projects generally in the same direction as the slot opening 424. As best seen in FIG. 12, in the illustrated embodiment, when the clip assembly 400 is in tension, the slot opening 424 normally projects outwardly away from the plane of the base panel 454. Thus, when linear tension is applied, the crossbar 440 is seated against the side of the retention pocket 430.

Upon the application of an upward folding force away from the plane of the base panel 454, the receiving body 422 rotates to a position in which the crossbar 440 is in alignment with the slot opening 424 (FIG. 13). Such lifting rotation also tensions the strap element 436 thereby introducing a force which urges the hook member 410 away from the stirrup member 420. Accordingly, when the rotation progresses to the condition where the crossbar 440 is aligned with the slot opening 424, the crossbar 440 will pop out of the receiving body 422 to relieve the applied forces thereby resulting in disengagement. As will be appreciated, such an arrangement permits a user to use a single hand to disengage the clip assembly 400 by lifting the distal wall 470 upwardly. Such one-handed disengagement may be desirable in some environments of use where a quick release is desired.

As illustrated, in the exemplary embodiment of FIGS. 11-13, the stirrup member includes an eyelet extension 450 having a forward pass through opening 484 and a rearward pass through opening 485. A spacer 487 separates the forward pass through opening and the rearward pass through opening. As will be appreciated, the forward pass through opening 484 and the rearward pass through opening 485 are adapted to receive an adjustment strap 452 such as rope, cord, webbing or the like such that the adjustment strap is threaded around the spacer in a cinching arrangement such that the effective length of the strap 452 may be lengthened or shortened as desired. As illustrated, in the exemplary configuration the eyelet extension 450 includes an upwardly angled distal wall 490 disposed in raised, sloped relation along a rear edge of the rearward pass through opening 485. As will be appreciated, such an angled surface may facilitate threading and tensioning adjustment. Of course, virtually any other configuration for the eyelet extension which provides length adjustment may be used if desired.

Of course, variations and modifications of the foregoing are within the scope of the present invention. Thus, it is to be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments and equivalents to the extent permitted by the prior art.

Various features of the invention are set forth in the following claims.

What is claimed is:

1. A foldable attachment clip assembly comprising:

a stirrup member including a crossbar oriented between opposing lateral legs, the crossbar having a height dimension extending between flattened upper and lower surfaces, the crossbar further having a width dimension extending between reduced profile leading and trailing edges; and a hook member including a receiving body adapted to receive the crossbar and an eyelet extension adapted to receive a strap element extending away from the receiving body, the receiving body having a hollow interior with a slot opening extending along the length of the receiving body, wherein the slot opening has a height dimension which is less than or equal to the height dimension of the crossbar, the slot opening defining an insertion path across a wall of the receiving body adapted for press-fit insertion of the crossbar to a portion of the hollow interior defining a retention pocket adapted to receive the crossbar, the retention pocket being nonconforming to the outer surface of the crossbar such that the upper and lower surfaces of the crossbar are spaced apart from opposing surfaces of the retention pocket when the crossbar is disposed at the interior of the retention pocket, the retention pocket further having an effective inner diameter which is greater than the effective outer diameter of the crossbar such that upon insertion of the crossbar into the retention pocket the hook member can rotate about the crossbar while maintaining all portions of the crossbar within the retention pocket throughout the range of rotation.

2. The foldable attachment clip assembly as recited in claim 1, wherein the stirrup member further includes an eyelet extension defining a tethering connection disposed substantially in the same plane as the crossbar, the eyelet extension including at least one tethering eyelet disposed at a position remote from the crossbar.

3. The foldable attachment clip assembly as recited in claim 2, wherein said at least one tethering eyelet is disposed between a rear cross member and a barrier extending between the opposing lateral legs in opposing relation to the crossbar.

4. The foldable attachment clip assembly as recited in claim 3, wherein the barrier is a curved bar defining a concave profile opposing the crossbar.

5. The foldable attachment clip assembly as recited in claim 1, wherein the crossbar includes flattened upper and lower surfaces defining boundaries of the height dimension.

6. The foldable attachment clip assembly as recited in claim 1, wherein the crossbar further includes a rounded leading edge adapted for insertion into the slot opening.

7. The foldable attachment clip assembly as recited in claim 6, wherein the crossbar further includes a rounded trailing edge facing away from the leading edge.

8. The foldable attachment clip assembly as recited in claim 1, wherein the stirrup member is a single piece molded polymer structure.

9. The foldable attachment clip assembly as recited in claim 1, wherein the slot opening has a pair of opposing planar boundary surfaces with the distance between the boundary surfaces defining the height dimension of the slot opening which is less than or equal to the height dimension of the crossbar, the slot opening defining an insertion path across a wall of the receiving body adapted for press-fit insertion of the crossbar.

10. The foldable attachment clip assembly as recited in claim 1, wherein the receiving body is substantially cylindrical in shape.

11. The foldable attachment clip assembly as recited in claim 10, wherein the receiving body is in the form of a circular barrel.

12. The foldable attachment clip assembly as recited in claim 10, wherein the crossbar extends between a pair of enhanced diameter end walls and wherein the length of the receiving body is substantially equivalent to the distance between the enhanced diameter end walls such that relative axial movement between the receiving body and the crossbar is blocked.

13. The foldable attachment clip assembly as recited in claim 1, wherein the eyelet extension includes a first pass through opening and at least a second pass through opening adapted to receive an adjustment strap.

14. A foldable attachment clip assembly comprising:

a stirrup member including a crossbar extending between a pair of enhanced diameter end walls. the crossbar having flattened upper and lower surfaces with a height dimension between the upper and lower surfaces, the crossbar further having a width dimension extending between reduced profile leading and trailing edges, the stirrup member further including a tethering connection having a first one eyelet extension including at least one eyelet disposed at a position remote from the crossbar between a rear cross member and a barrier element disposed in opposing relation to the crossbar; and a hook member including a substantially cylindrical receiving body adapted to receive the crossbar and a second eyelet extension extending away from the receiving body, the receiving body having a hollow interior with a slot opening extending along the length of the receiving body, wherein the second eyelet extension extends away from the receiving body at an angle transverse to the slot opening and wherein the slot opening has a pair of opposing planar boundary surfaces with the distance between the boundary surfaces defining the height dimension of the slot opening which is less than or equal to the height dimension of the crossbar, the slot opening defining an insertion path across a wall of the receiving body adapted for press-fit insertion of the crossbar to a portion of the hollow interior defining a retention pocket adapted to receive the crossbar, the retention pocket being nonconforming to the outer surface of the crossbar such that the upper and lower surfaces of the crossbar are spaced apart from opposing surfaces of the retention pocket when the crossbar is disposed at the interior of the retention pocket, the retention pocket further having an effective inner diameter which is greater than the effective outer diameter of the crossbar such that upon insertion of the crossbar into the retention pocket the hook member can rotate about the crossbar while maintaining all portions of the crossbar within the retention pocket throughout the range of rotation and wherein the second eyelet extension includes at least one eyelet adapted to receive a strap element.

15. The foldable attachment clip assembly as recited in claim 14, wherein the first eyelet extension is disposed substantially in the same plane as the crossbar, and wherein the barrier element is a curved bar defining a concave profile opposing the crossbar.

16. The foldable attachment clip assembly as recited in claim 15, wherein the receiving body is in the form of a circular barrel.

17. The foldable attachment clip assembly as recited in claim 16, wherein the length of the receiving body is substantially equivalent to the distance between the enhanced diameter end walls such that relative axial movement between the receiving body and the crossbar is blocked.

18. The foldable attachment clip assembly as recited in claim 14, wherein at least one of the first eyelet extension and the second eyelet extension includes a first pass through opening and at least a second pass through opening adapted to receive an adjustment strap.

19. A foldable attachment clip assembly comprising;

a stirrup member including a crossbar extending between a pair of enhanced diameter end walls, the crossbar being oriented between opposing lateral legs of the stirrup member, the crossbar having flattened upper and lower surfaces with a height dimension between the upper and lower surfaces, the crossbar further having a width dimension extending between reduced profile leading and trailing edges, the stirrup member further including a tethering connection having at least one eyelet disposed at a position remote from the crossbar between a rear cross member and a curved barrier element disposed in opposing relation to the crossbar; and a hook member including a substantially cylindrical receiving body adapted to receive the crossbar and an eyelet extension extending in angled relation away from the receiving body, the receiving body having a generally "C" shaped cross-sectional profile having a hollow interior with a slot opening extending along the length of the receiving body, wherein the eyelet extension extends away from the receiving body at an angle transverse to the slot opening and wherein the slot opening has a pair of opposing planar boundary surfaces with the distance between the boundary surfaces defining the height dimension of the slot opening which is less than or equal to the height dimension of the crossbar, the slot opening defining an insertion path across a wall of the receiving body adapted for press-fit insertion of the crossbar to a portion of the hollow interior defining a retention pocket adapted to receive the crossbar, the retention pocket being nonconforming to the outer surface of the crossbar such that the upper and lower surfaces of the crossbar are spaced apart from opposing surfaces of the retention pocket when the crossbar is disposed at the interior of the retention pocket, the retention pocket further having an effective inner diameter which is greater than the effective outer diameter of the crossbar such that upon insertion of the crossbar into the retention pocket the hook member can rotate about the crossbar while maintaining all portions of the crossbar within the retention pocket throughout the range of rotation, the length of the receiving body being substantially equivalent to the distance between the enhanced diameter end walls to block relative axial movement between the receiving body and the crossbar, and wherein the eyelet extension includes a first pass through opening and at least a second pass through opening adapted to receive an adjustment strap.

20. The foldable attachment clip assembly as recited in claim 19, wherein the second pass through opening is disposed rearward of the first pass through opening, and wherein an upwardly angled distal wall is disposed in raised, sloped relation along a rear edge of the second pass through opening.

* * * * *